US008573128B2

(12) United States Patent
Storm et al.

(10) Patent No.: US 8,573,128 B2
(45) Date of Patent: Nov. 5, 2013

(54) MULTI COMPONENT REACTIVE METAL PENETRATORS, AND THEIR METHOD OF MANUFACTURE

(75) Inventors: Roger S. Storm, Tucson, AZ (US); Vladimir Shapovalov, Albuquerque, NM (US); James C. Withers, Tucson, AZ (US); Raouf Loutfy, Tucson, AZ (US)

(73) Assignee: Materials & Electrochemical Research Corp., Tucson, AZ (US)

( * ) Notice: Subject to any disclaimer, the term of this patent is extended or adjusted under 35 U.S.C. 154(b) by 634 days.

(21) Appl. No.: 11/764,036

(22) Filed: Jun. 15, 2007

(65) Prior Publication Data

US 2008/0047458 A1 Feb. 28, 2008

Related U.S. Application Data

(60) Provisional application No. 60/805,124, filed on Jun. 19, 2006, provisional application No. 60/805,128, filed on Jun. 19, 2006.

(51) Int. Cl.
*F42B 12/00* (2006.01)

(52) U.S. Cl.
USPC ..... 102/517; 102/501

(58) Field of Classification Search
USPC ..... 102/517, 519, 501; 419/1
See application file for complete search history.

(56) References Cited

U.S. PATENT DOCUMENTS

| | | | | | |
|---|---|---|---|---|---|
| 2,401,483 | A | * | 6/1946 | Hensel et al. | 102/519 |
| 2,883,284 | A | * | 4/1959 | Lawthers | 75/245 |
| 3,946,673 | A | | 3/1976 | Hayes | 102/52 |
| 4,109,131 | A | * | 8/1978 | Schluter | 219/137.62 |
| 4,381,692 | A | | 5/1983 | Weintraub | 86/20 B |
| 4,592,283 | A | * | 6/1986 | Hellner et al. | 102/493 |
| 4,767,908 | A | | 8/1988 | Dallavalle et al. | 219/121.5 |
| 4,807,795 | A | | 2/1989 | LaRocca et al. | 228/107 |
| 4,901,137 | A | * | 2/1990 | Sato et al. | 257/712 |
| 4,940,404 | A | * | 7/1990 | Ammon et al. | 419/28 |
| 5,124,122 | A | | 6/1992 | Wojcik | 420/421 |
| 5,308,659 | A | | 5/1994 | Oyagi et al. | 427/428 |
| 5,482,672 | A | | 1/1996 | Friedman et al. | 419/42 |
| 5,525,560 | A | * | 6/1996 | Yamazaki et al. | 501/103 |
| 5,567,908 | A | | 10/1996 | McCubbin et al. | 102/519 |
| 5,760,317 | A | | 6/1998 | Kapoor | 75/248 |
| 5,950,064 | A | * | 9/1999 | Robinson et al. | 419/47 |
| 6,010,580 | A | * | 1/2000 | Dandliker et al. | 148/403 |
| 6,123,896 | A | * | 9/2000 | Meeks et al. | 419/49 |
| 6,228,140 | B1 | * | 5/2001 | Meeks et al. | 75/245 |
| 6,293,987 | B1 | * | 9/2001 | Hajaligol et al. | 75/255 |
| 6,294,130 | B1 | * | 9/2001 | Hajaligol et al. | 419/31 |
| 6,393,991 | B1 | | 5/2002 | Funston et al. | 102/476 |

(Continued)

FOREIGN PATENT DOCUMENTS

WO WO2005036093 4/2005

OTHER PUBLICATIONS

U.S. Appl. No. 60/729,533, filed Oct. 20, 2005, Storm et al.

(Continued)

*Primary Examiner* — Benjamin P Lee
(74) *Attorney, Agent, or Firm* — Hayes Soloway P.C.

(57) ABSTRACT

A penetrator comprising a layered composite of at least one high density metal and at least one reactive metal material such as a reactive metal.

25 Claims, 3 Drawing Sheets

Experimental setup to produce a Ta-Zr alloy: 1 – plasma transferred arc torch;

2 – Zr wire; 3 – Ta powder; 4 – graphite casting mold; 5 – Ta-Zr alloy.

(56) References Cited

U.S. PATENT DOCUMENTS

| | | | | |
|---|---|---|---|---|
| 6,446,558 | B1 * | 9/2002 | Peker et al. | 102/306 |
| 6,679,176 | B1 * | 1/2004 | Zavitsanos et al. | 102/364 |
| 7,191,709 | B2 | 3/2007 | Nechitailo | 102/518 |
| 7,226,492 | B2 * | 6/2007 | Mahot et al. | 75/248 |
| 7,278,354 | B1 | 10/2007 | Langan et al. | 102/306 |
| 7,329,382 | B2 * | 2/2008 | Amick | 419/33 |
| 7,383,775 | B1 * | 6/2008 | Mock et al. | 102/363 |
| H2230 | H * | 8/2009 | Nechitailo | 102/517 |
| 2002/0059882 | A1 * | 5/2002 | Begg | 102/518 |
| 2005/0072498 | A1 * | 4/2005 | Begg | 148/562 |
| 2005/0199323 | A1 * | 9/2005 | Nielson et al. | 149/19.3 |
| 2006/0011487 | A1 * | 1/2006 | Griego et al. | 205/143 |
| 2006/0288897 | A1 * | 12/2006 | Williams et al. | 102/364 |
| 2008/0047458 | A1 * | 2/2008 | Storm et al. | 102/501 |
| 2010/0024676 | A1 * | 2/2010 | Hugus et al. | 102/514 |

OTHER PUBLICATIONS

Official Action dated Apr. 14, 2011 issued in corresponding U.S. Appl. No. 11/764,106, (7 pgs).

Official Action dated Aug. 16, 2011 issued in corresponding U.S. Appl. No. 11/764,106, (4 pgs).

International Search Report and Written Opinion issued in corresponding application No. PCT/US2007/071484, dated Jun. 19, 2013 (12 pgs).

* cited by examiner

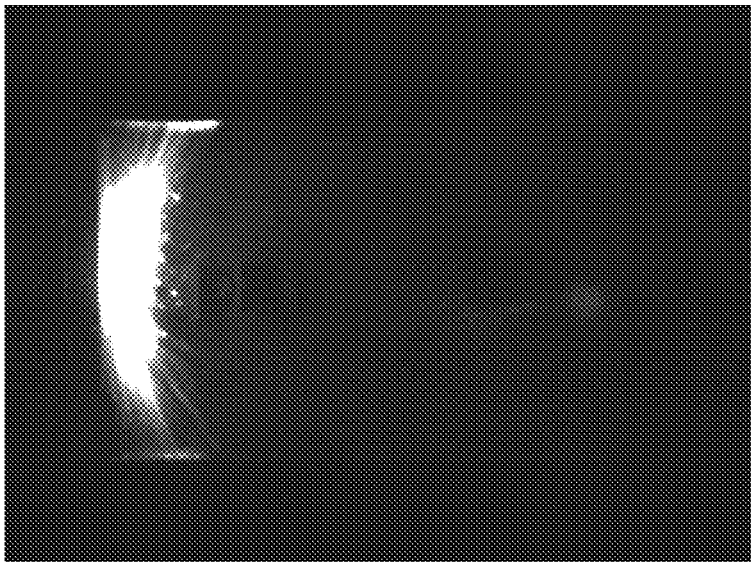
Figure 1 Optical image of steel penetrator gun launch at 5370 ft/sec showing impact with back wall of test chamber
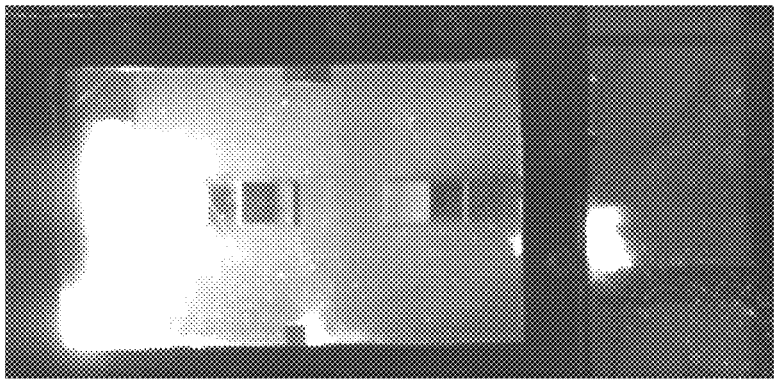
Figure 2 Optical image of Ta penetrator gun launch at 5818 ft/sec showing impact with back wall of test chamber

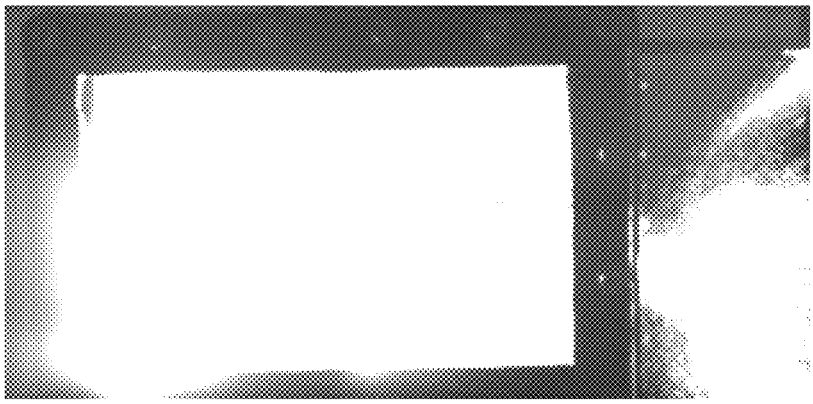
Figure 3 Optical image of Zr penetrator gun launch at 5797 ft/sec showing impact with back wall of test chamber
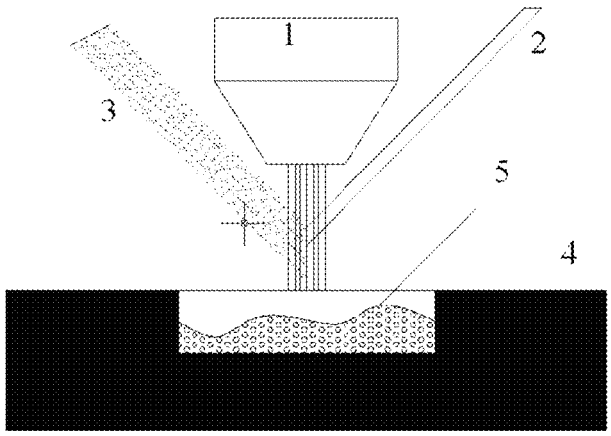
Figure 4 Experimental setup to produce a Ta-Zr alloy: 1 – plasma transferred arc torch; 2 – Zr wire; 3 – Ta powder; 4 – graphite casting mold; 5 – Ta-Zr alloy.

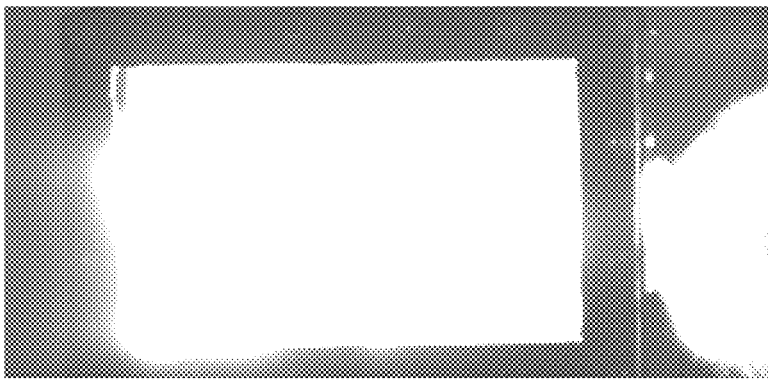
Figure 5 Optical image of Ta/Zr alloy penetrator gun launch at 7242 ft/sec showing impact with back wall of test chamber
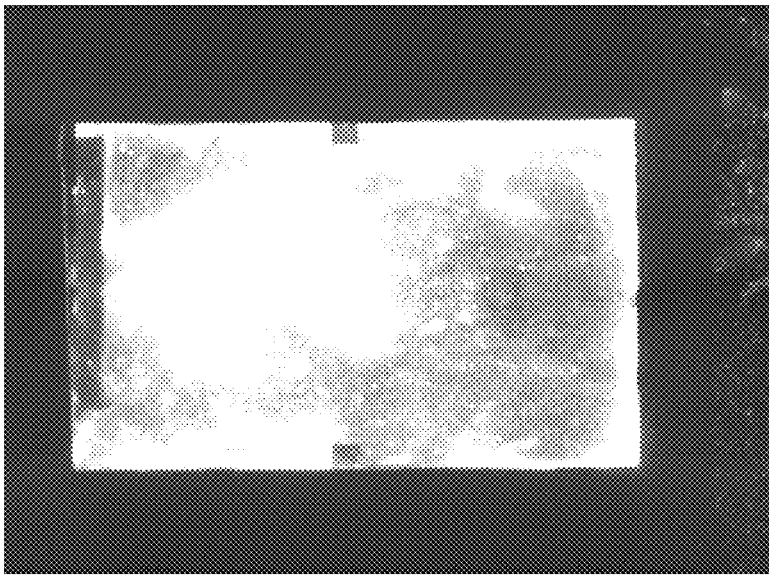
Figure 6 Optical image of Ta/Zr layered composite penetrator gun launch at 6255 ft/sec showing impact with back wall of test chamber

MULTI COMPONENT REACTIVE METAL PENETRATORS, AND THEIR METHOD OF MANUFACTURE

CROSS REFERENCE TO RELATED APPLICATIONS

This application claims priority from U.S. Provisional Application Ser. No. 60/805,124, and U.S. Provisional Application Ser. No. 60/805,128, both filed Jun. 19, 2006, the contents of which are incorporated hereby reference.

FIELD OF THE INVENTION

The present invention relates to penetrators and methods for their manufacture.

1. Background of the Invention

Penetrators are used as a weapon against airborne or land based targets. These penetrators can take the form of a metal cube, (e.g. ¼"×¼"×¼"), or an explosively formed penetrator with a 3-dimensional geometry. When explosively launched they can cause significant damage by penetrating the outer surface or skin of a target such as an aircraft, missile, tank or other vehicle owing to their momentum. As such, it is preferable to make these penetrator cubes from a heavy metal. Historically, steel (7.85 gm/cc) has been used for these penetrators. However, heavier metals such as tantalum (Ta—16.3 g/cc) or depleted uranium (U—18.9 g/cc) are also of interest. The momentum of the high density projectile gives it outstanding properties as a penetrator.

A second type of penetrator depends on reactive energy release. After penetrating the skin of the target, a fragment of reactive material can react with oxygen to create a sustainable reaction. The latter produces both a fire start capability and overpressure within the target volume. Materials with sufficient reactivity include zirconium (6.3 g/cc), aluminum (2.7 g/cc), or magnesium (1.74 g/cc). However, the relatively low density of these materials makes them less suitable as kinetic energy penetrators.

Thus, there is a need for penetrators which combine both high density for purposes of penetration, as well as reactivity.

2. Brief Description of the Prior Art

LaRocca in U.S. Pat. No. 4,807,795 describes a method for producing a bimetallic conoid. The method consists of first explosively bonding two metal disks and then shear-forming the bonded disks into a conoidal shape simultaneously over a mandrel. McCubbin in U.S. Pat. No. 5,567,908 describes a reactive case warhead comprised of magnesium, aluminum, zinc and zirconium that is made in such a manner as to maximize blast damage once the warhead penetrates the external shell of a target. The warhead employs a hardened steel front plate made in such a way to penetrate the walls of the target and that is specially shaped to insure a ripping or tearing of the exterior walls as the warhead enters. An end-loaded fuse ignites the explosive charge and reactive case at the proper time. Both of these prior patented inventions have inherent limitations, and are difficult to manufacture.

In our earlier U.S. Provisional Application Ser. No. 60/729,533, filed Oct. 20, 2005, we describe a bimetallic layered penetrator of Zr/Ta/Zr produced by the plasma transferred arc solid free form fabrication (PTA SFFF) process. The resulting bimetallic layered penetrator was found to have sufficient mass and momentum to penetrate a target, and carry the reactive Zr into the target, resulting in considerably more damage than a non-reactive penetrator such as steel, and was particularly suited for manufacture of cube geometry penetrators. However, the presence of non-uniformities resulting from the layered bimetallic structure can cause difficulties in the explosive launch process.

Another type of bimetallic penetrator is a shaped penetrator which has a 3-dimensional geometry and is produced by the explosive forming process. However, the presence of possible non-uniformities resulting from the layered bimetallic structure also could cause difficulties in the explosive forming process.

SUMMARY OF THE INVENTION

The present invention overcomes the aforesaid and other disadvantages of the prior art. In accordance with the present invention we provide a penetrator formed of an alloy or composite of a high density metal and a reactive material. Unlike the bimetallic structures of the prior art, a penetrator made of a composite or an alloy has a uniform structure throughout. Thus, a penetrator formed, for example, of a high density metal and a reactive metal will have sufficient mass to penetrate steel plate, and upon striking the steel plate, provide a very substantial release of energy which would be seen to compare favorably to that obtained with a penetrator formed only of a high density metal or a penetrator formed only of a reactive metal, of the same size, launched at the same speed.

BRIEF DESCRIPTION OF THE DRAWINGS

Further features and advantages of the present invention will be seen from the following detailed description, taken in conjunction with the accompanying drawings, wherein like numerals depict like parts, and wherein:

FIG. 1 is an optical image of a prior art steel penetrator gun launch at 5,370 feet/second showing impact with the back wall of a test chamber;

FIG. 2 is an optical image of a prior art tantalum (Ta) penetrator gun launch at 5,818 feet/second showing impact with the back wall of a test chamber;

FIG. 3 is an optical image of a prior art zirconium (Zr) penetrator gun launch at 5,797 feet/second showing impact with the back wall of a test chamber;

FIG. 4 is a schematic view showing production of a Ta/Zr alloy penetrator in accordance with the present invention;

FIG. 5 is an optical image of a Ta/Zr alloy penetrator gun launch at 7,242 feet/second showing impact with the back wall of a test chamber; and FIG. 6 is an optical image of a Ta/Zr layered composite penetrator gun launch at 6,255 feet/second showing impact with the back wall of a test chamber.

DETAILED DESCRIPTION OF PREFERRED EMBODIMENT

The present invention provides penetrators formed of a composite or an alloy of a high density metal and a reactive material.

As used herein the term "high density metal" means a metal having a density of greater than about 13.1 g/cc or about 817 lbs./cu feet. The term "reactive material" means a material that is capable of substantial energy release, e.g., through oxidation reaction.

The homogeneity of the composite or alloy provides an extremely uniform structure which will facilitate the manufacture of shaped penetrators by the explosive forming process. Comparable uniformity and energy release can be obtained by utilizing a particulate composite manufactured using a powder of one metal and a molten metal of a second composition, e.g. Ta metal in a Zr matrix. Other heavy and/or reactive metals can be used in the manufacture of alloy and particulate composites in accordance with the present invention, e.g. an alloy of W as the heavy metal with Zr as the reactive metal. More than two metals can be used as well, e.g. ternary, quaternary and higher composition alloys and particulate composites. The alloys and particulate composites can be manufactured by any process that melts one or more of the metals. This can include, but is not limited to, the use of a plasma torch such as a welding torch, laser, furnace melting, arc melting, and induction and e-beam melting. Alternatively hot consolidation can be employed such as hot pressing in a die, hot isostatic pressing (HIP), and cold pressing followed by sintering below or above the melting point of one of the constituents such as the active metal zirconium.

As can be seen in the examples below if a Zr penetrator can penetrate the target structure, a very high level of reaction is obtained, which is desirable for weapon lethality. With a Ta/Zr alloy, the pressure buildup in the chamber, and the extent of reaction as indicated by residue after testing indicates the alloy composition is more effective than a pure Zr layer. It is believed that the increased pressure is the result of increased surface area in the alloy fragment after impact with the target when compared to the response of a pure Zr or the layered bimetallic penetration. Compared to pure Zr, a penetrator formed of Ta/Zr alloy would have a considerably higher mass density which would result in greater penetration capability than Zr alone.

Preferred as high density metals in accordance with the present invention are Ta, W, Re, Os, Ir, Pt, Au, U, and Hf, and an alloy thereof. Preferred as reactive materials in accordance with the present invention are reactive metals such as Zr, Mg, Al, Li, Be, Ti, Sc, V, H, Sr, Y, Si, Ge, and Nd, and an alloy thereof, or a rare earth metal and an alloy thereof, e.g., La, Ce, Pr, Nd, Pm, Sm, Eu, Gd, Tb, Dy, Ho, En, Tm, Yb and Lu. Other reactive materials include hydrogen or carbon or a metal carbide.

The invention will be further demonstrated by the following non-limiting examples:

COMPARATIVE EXAMPLE 1

In this test, a steel cube with dimensions of ¼" was gun launched at a speed of 5370 ft/sec and targeted at a steel encased test chamber. The experiment was instrumented with pressure transducers attached to the target chamber, an optical pyrometer to measure temperature, and a high speed digital camera to image the energy release. The cube penetrated the 0.060" mild steel entrance plate, and then traversed the target chamber to a ¾" rear plate. The energy release is shown in FIG. 1. No increase in pressure or temperature in the chamber was detected.

COMPARATIVE EXAMPLE 2

In this test, a Ta cube with dimensions of ¼" was gun launched at a speed of 5818 ft/sec and targeted at a steel encased test chamber. The experiment was instrumented with pressure transducers attached to the target chamber, an optical pyrometer to measure temperature, and a high speed digital camera to image the energy release. The cube penetrated the 0.060" mild steel entrance plate, and then traversed the target chamber to a ¾" rear plate. The energy release as noted by optical imaging is shown in FIG. 2 and appears higher than that observed for the steel cube in Example 1. A pressure increase to 2.1 psi was recorded. This is a result of Ta having a greater reactivity with oxygen than steel. The maximum temperature in the chamber was <1500° K. This is the lowest temperature that can be measured. It was estimated that >30% of the original penetrator mass remained on the chamber floor after the test was completed.

COMPARATIVE EXAMPLE 3

In this test, a Zr cube with dimensions of ¼" was gun launched at a speed of 5297 ft/sec and targeted at a steel encased test chamber. The experiment was instrumented with pressure transducers attached to the target chamber, an optical pyrometer to measure temperature, and a high speed digital camera to image the energy release. The cube penetrated the 0.060" mild steel entrance plate, and then traversed the target chamber to a ¾" rear plate. The energy release as noted by optical imaging is shown in FIG. 3 and appears much higher than that observed for the steel cube in Example 1 or the Ta cube shown in Example 2. A pressure increase to 7.3 psi and a temperature increase to 4500° K were recorded. It was estimated that ~10% of the original penetrator mass remained on the chamber floor after the test was completed, indicating a high level of reaction. While the Zr had sufficient mass density to penetrate the thin (0.060") entry plate, it does not have sufficient mass density to penetrate thicker targets for which the penetrator technology is likely to be directed, e.g. missiles or other aircraft or vehicular targets.

INVENTION EXAMPLE 1

An alloy of Ta and Zr was prepared by melting Zr and Ta metals in the arc of a plasma transferred arc (PTA) welding torch and depositing the product in a graphite crucible as shown in FIG. 4. A current of 250 amps was used for the PTA torch, which was sufficient to melt both the Ta powder and Zr wire. The molar ratio was approximately 1.3Ta:1Zr. After cooling to room temperature, the alloy was machined into cubes with dimensions of ¼" by EDM machining. The cubes were gun launched at a speed of 7242 ft/sec and targeted at a steel encased test chamber. The experiment was instrumented with pressure transducers attached to the target chamber, an optical pyrometer to measure temperature, and a high speed digital camera to image the energy release. The cube penetrated the 0.060" mild steel entrance plate, and then traversed the target chamber to a ¾" rear plate. The energy release as noted by optical imaging is shown in FIG. 5, and appears comparable to that obtained for pure Zr in Example 3. A temperature rise to 4800° K was measured in the chamber with a pressure of 12.5 psi. It was estimated that <5% of the original penetrator mass remained on the chamber floor after the test was completed, indicating a very high level of reaction.

INVENTION EXAMPLE 2

A layered composite of Ta and Zr was prepared by depositing a layer of Zr on each side of a ⅛" Ta plate at a torch amperage of 225 amps. After cooling to room temperature, the alloy was machined into cubes with a dimension of ¼" by EDM machining. The molar ratio of the Ta and the Zr in the cubes was approximately 1.3Ta:1Zr. The cubes were gun launched at a speed of 6255 ft/sec and targeted at a steel encased test chamber. The experiment was instrumented with pressure transducers attached to the target chamber, an optical pyrometer to measure temperature, and a high speed digital camera to image the energy release. The cube penetrated the 0.060" mild steel entrance plate, and then traversed the target chamber to a ¾" rear plate. The energy release as noted by optical imaging is shown in FIG. 5. A temperature rise to ~3800° K was measured in the chamber with a pressure increase of 8.7 psi. It was estimated that ~20% of the original penetrator mass remained on the chamber floor after the test was completed, indicating a high level of reaction compared to Ta, but lower than for Zr or the Ta/Zr alloy. The incomplete combustion resulted in a lower total energy release than Zr or the Ta/Zr alloy as indicated by the optical micrograph in FIG. 5.

INVENTION EXAMPLE 3

An alloy of W and Zr was prepared using the experimental setup as shown in FIG. 4 with a feed of W powder and Zr wire. An amperage for the PTA torch of 280 amps was used which was sufficient to melt both metals. After cooling to room temperature, the alloy was machined into cubes with a dimension of ¼" by EDM machining. The molar ratio of the W and the Zr in the cubes was approximately 1.3W:1Zr. The cubes were gun launched tested by targeting the penetrator cube at a steel encased test chamber which was instrumented with optical imaging.

INVENTION EXAMPLE 4

A particulate composite of Ta and Zr was prepared using the experimental setup as shown in FIG. 4 using a feed of Ta powder and Zr wire and with an amperage for the PTA torch of 190 amps. This power level was sufficient to melt the Zr metal but not the Ta powder. After cooling to room temperature, the composite was machined into cubes with a dimension of ¼" by EDM machining. The molar ratio of the Ta and the Zr in the cubes was approximately 1.3Ta:1Zr. The cubes were gun launched and targeted at a steel encased test chamber which was instrumented with optical imaging.

It should be understood that the preceding is merely a detailed description of certain preferred embodiments of this invention and that numerous changes can be made in accordance with the disclosure herein without departing from the spirit or scope of the invention. The following examples are to be viewed as illustrative of the present invention and should not be viewed as limiting the scope of the invention as defined by the appended claims.

We claim:

1. A process for forming a penetrator, which comprises heating at least one heavy metal and at least one reactive metal to a temperature sufficient to melt at least one of the metals, but below the melting point of at least one other of the metals, wherein the heating is effected by the use of a welding torch.

2. The process of claim 1, wherein the high density metal is Ta and the reactive material is Zr.

3. The process of claim 1, wherein the high density metal is selected from the group consisting of Ta, W, Re, Os, Ir, Pt, Au, U, and Hf, and an alloy thereof, and the reactive material is a reactive metal selected from the group consisting of Zr, Mg, Al, Li, Be, Ti, Sc, V, H, Sr, Y, Si, and Ge, and an alloy thereof, a rare earth element and an alloy thereof, hydrogen, carbon and a metal carbide.

4. The process of claim 3, wherein the rare earth metal is selected from the group consisting of La, Ce, Pr, Nd, Pm, Sm, Eu, Gd, Tb, Dy, Ho, Er, Tm, Yb and Lu.

5. The process of claim 1, wherein the heating is effected by the use of a laser.

6. The process of claim 1, wherein said welding torch comprises a plasma transferred arc, a TIG, a MIG or an E-beam torch.

7. The process of claim 1, wherein the penetrator is shaped into a cube.

8. The of claim 1, including the step of shaping the penetrator with a three-dimensional curvature by an explosive forming process.

9. A process for forming the penetrator as claimed in claim 1, including the step of consolidating the at least one high density metal and the at least one reactive metal by powder metallurgical processing.

10. The process of claim 9, wherein the powder metallurgical processing comprises pressureless sintering, hot pressing and hot isostatic pressing.

11. The process of claim 1, wherein the high density, high reactive component is selected from the group consisting of Ta—H, U—H and Pu—H, and a mixture thereof.

12. The process, for forming a penetrator, which comprises heating at least one heavy metal and at least one reactive metal to a temperature sufficient to melt at least one of the metals, but below the melting point of at least one other of the metals, wherein the heating is effected by the use of a furnace.

13. The process of claim 12, wherein the high density metal is Ta and the reactive material is Zr.

14. The process of claim 12, wherein the high density metal is selected from the group consisting of Ta, W, Re, Os, Ir, Pt, Au, U, and Hf, and an alloy thereof, and the reactive material is a reactive metal selected from the group consisting of Zr, Mg, Al, Li, Be, Ti, Sc, V, H, Sr, Y, Si, and Ge, and an alloy thereof, a rare earth element and an alloy thereof, hydrogen, carbon and a metal carbide.

15. A process for forming the penetrator as claimed in claim 14, including the step of consolidating the at least one high density metal and the at least one reactive metal by powder metallurgical processing.

16. The process of claim 15, wherein the powder metallurgical processing comprises pressureless sintering, hot pressing and hot isostatic pressing.

17. The process of claim 12, wherein the rare earth metal is selected from the group consisting of La, Ce, Pr, Nd, Pm, Sm, Eu, Gd, Tb, Dy, Ho, Er, Tm, Yb and Lu.

18. The process of claim 12, wherein the penetrator is shaped as a cube.

19. The process of claim 12, including the step of shaping the penetrator with a three-dimensional curvature by an explosive forming process.

20. The process, for forming a penetrator, which comprises heating at least one heavy metal and at least one reactive metal to a temperature sufficient to melt at least one of the metals, but below the melting point of at least one other of the metals, wherein the heating is effected by the use of a vacuum arc.

21. The process of claim 20, wherein the penetrator is shaped as a cube.

22. The process of claim 20, including the step of shaping the penetrator with a three-dimensional curvature by an explosive forming process.

23. The process of claim 20, wherein the high density metal is Ta and the reactive material is Zr.

24. The process of claim 20, wherein the high density metal is selected from the group consisting of Ta, W, Re, Os, Ir, Pt, Au, U, and Hf, and an alloy thereof, and the reactive material is a reactive metal selected from the group consisting of Zr, Mg, Al, Li, Be, Ti, Sc, V, H, Sr, Y, Si, and Ge, and an alloy thereof, a rare earth element and an alloy thereof, hydrogen, carbon and a metal carbide.

25. The process of claim 24, wherein the rare earth metal is selected from the group consisting of La, Ce, Pr, Nd, Pm, Sm, Eu, Gd, Tb, Dy, Ho, Er, Tm, Yb and Lu.

* * * * *